US011456564B2

(12) United States Patent
Ikushima

(10) Patent No.: US 11,456,564 B2
(45) Date of Patent: Sep. 27, 2022

(54) CABLE UNIT, AND LIQUID MATERIAL SUPPLY DEVICE AND APPLICATION DEVICE IN WHICH SAID CABLE UNIT IS USED

(71) Applicant: MUSASHI ENGINEERING, INC., Mitaka (JP)

(72) Inventor: Kazumasa Ikushima, Tokyo (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 207 days.

(21) Appl. No.: 16/605,852

(22) PCT Filed: Apr. 24, 2018

(86) PCT No.: PCT/JP2018/016641
§ 371 (c)(1),
(2) Date: Oct. 17, 2019

(87) PCT Pub. No.: WO2018/199103
PCT Pub. Date: Nov. 1, 2018

(65) Prior Publication Data

US 2021/0126405 A1 Apr. 29, 2021

(30) Foreign Application Priority Data

Apr. 28, 2017 (JP) ..... JP2017-089136

(51) Int. Cl.
*H01R 13/66* (2006.01)
*B05B 12/16* (2018.01)
(Continued)

(52) U.S. Cl.
CPC ..... *H01R 13/665* (2013.01); *B05B 12/16* (2018.02); *B05B 13/0431* (2013.01); *B05C 5/02* (2013.01);
(Continued)

(58) Field of Classification Search
None
See application file for complete search history.

(56) References Cited

U.S. PATENT DOCUMENTS 5,060,860 A 10/1991 Megerle
5,098,024 A * 3/1992 MacIntyre ..... B05B 13/0431 239/587.1
(Continued)

FOREIGN PATENT DOCUMENTS

EP 1084757 A2 3/2001
JP 2003033350 A 2/2003
(Continued)

OTHER PUBLICATIONS

Supplemental European Search Opinion for Application No. EP 18791474.*
(Continued)

*Primary Examiner* — Jethro M. Pence
(74) *Attorney, Agent, or Firm* — WHDA, LLP

(57) ABSTRACT

Problems: To provide a cable unit that can save space for a work space, and a liquid material supply device and an application device including the cable unit. Solution: A cable unit 30 that detachably and electrically connects a discharge head 10 configured to discharge a liquid material with a relative-moving robot 20 configured to carry out relative movement between the discharge head 10 and a workpiece 25, the cable unit having a dispense controller 33 configured to control a discharge operation of the discharge head 10, and a liquid material supply device and an application device including the cable unit.

17 Claims, 11 Drawing Sheets

(51) Int. Cl.

| | |
|---|---|
| ***B05B 13/04*** | (2006.01) |
| ***B05C 11/10*** | (2006.01) |
| ***B05C 5/02*** | (2006.01) |
| ***H01R 13/502*** | (2006.01) |
| ***H01R 13/621*** | (2006.01) |

(52) U.S. Cl.
CPC ..... *B05C 11/10* (2013.01); *B05C 11/1002* (2013.01); *H01R 13/502* (2013.01); *H01R 13/6215* (2013.01)

(56) References Cited

U.S. PATENT DOCUMENTS

| | | | | |
|---|---|---|---|---|
| 5,320,283 | A * | 6/1994 | Hollstein | B05B 13/0431 239/695 |
| 6,758,423 | B1 | 7/2004 | Perkins et al. | |
| 6,835,248 | B1 * | 12/2004 | Haas | B25J 19/0079 118/323 |
| 2004/0115567 | A1 | 6/2004 | Mandal et al. | |
| 2009/0285983 | A1 | 11/2009 | Baldauf et al. | |
| 2010/0057251 | A1 | 3/2010 | Ikushima | |
| 2011/0236578 | A1 | 9/2011 | Matsui et al. | |
| 2014/0100685 | A1 | 4/2014 | Baldauf et al. | |
| 2015/0246368 | A1 | 9/2015 | Ikushima | |
| 2015/0347348 | A1 | 12/2015 | Gouw | |
| 2016/0306364 | A1 | 10/2016 | Ikushima | |

FOREIGN PATENT DOCUMENTS

| | | | |
|---|---|---|---|
| JP | 2003275647 | A | 9/2003 |
| JP | 2013095116 | A | 5/2013 |
| JP | 2013-184116 | A | 9/2013 |
| KR | 10-2011-0106809 | A | 9/2011 |
| TW | 200412633 | A | 7/2004 |
| TW | I530325 | B | 4/2016 |
| WO | 91/02598 | A1 | 3/1991 |
| WO | 2007/083585 | A1 | 7/2007 |
| WO | 2008/022708 | A1 | 2/2008 |
| WO | 2015/83722 | A1 | 6/2015 |

OTHER PUBLICATIONS

Supplementary European Search Report dated Jan. 21, 2021, issued in counterpart EP Application No. 18791474.2. (1 page).
Office Action dated Jan. 25, 2021, issued in counterpart CN Application No. 201880028120.9, with English Translation. (16 pages).
Office Action dated Jun. 6, 2022, counterpart to KR Application No. 10-2019-7030954, with English Translation. (9 pages).
Office Action dated Jul. 18, 2022, issued in counterpart TW Application No. 107114544, with Search Report and English Translation of Search Report. (7 pages).

* cited by examiner

[Fig.1]
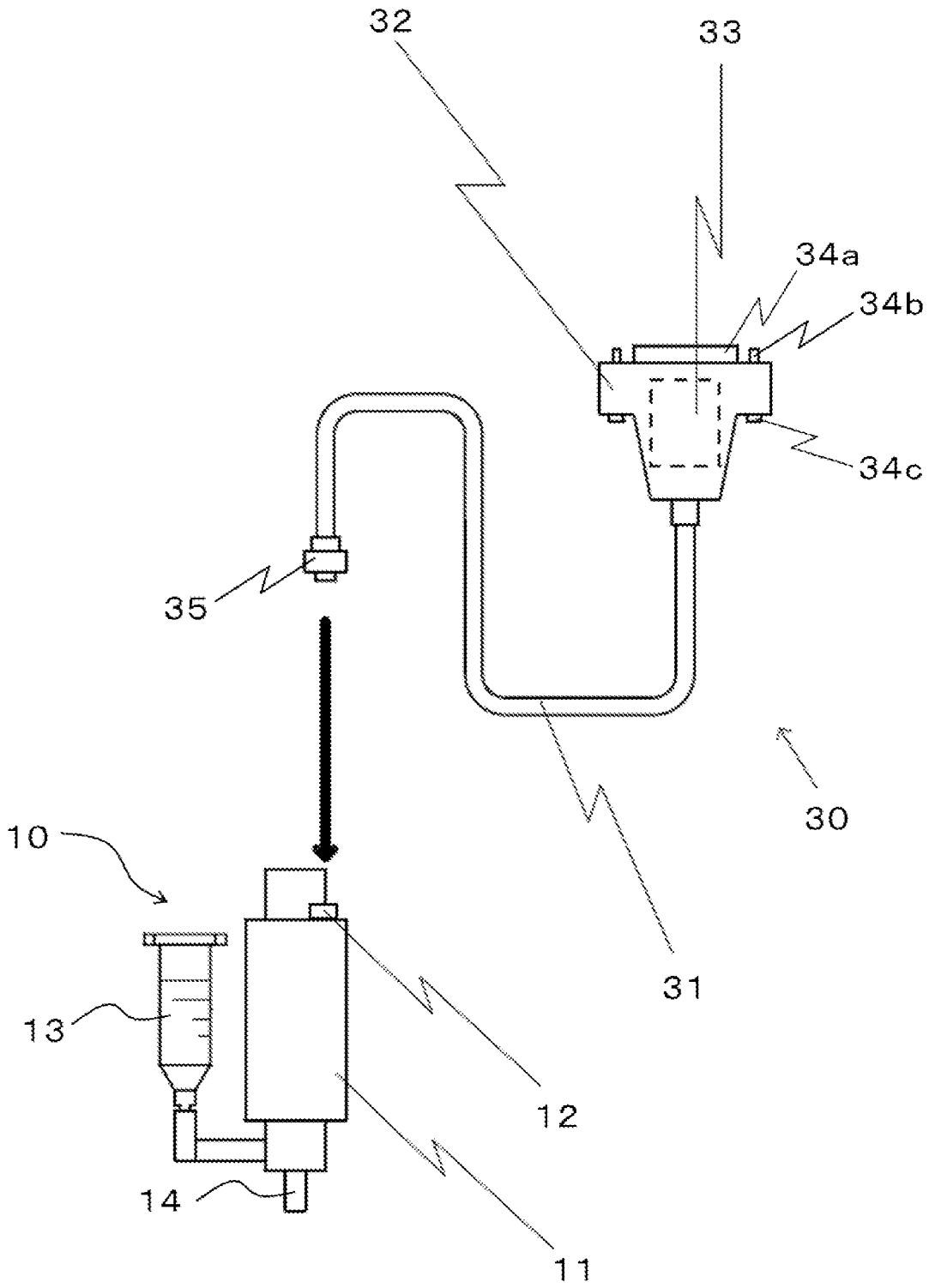

[Fig.2]
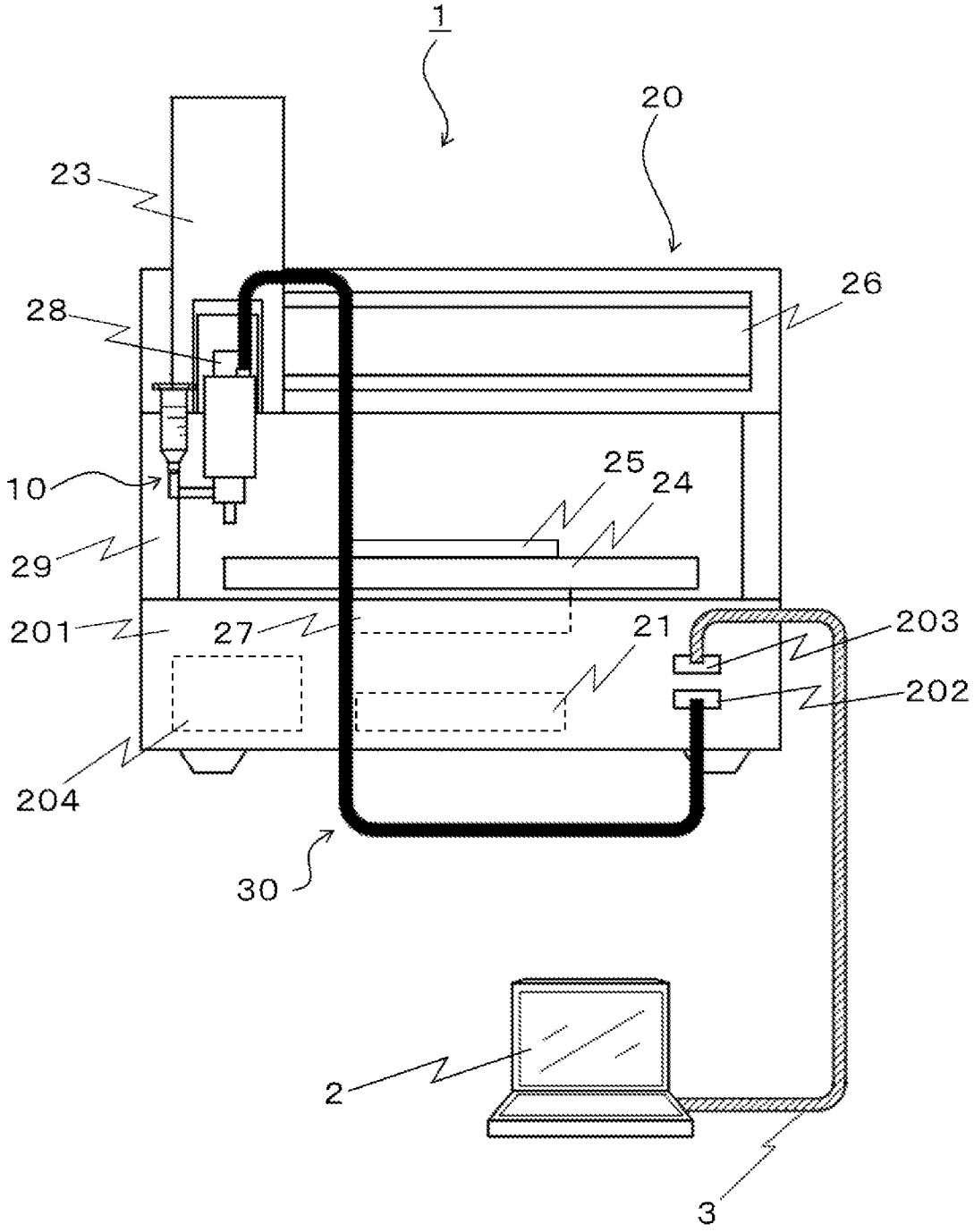

[Fig.3]
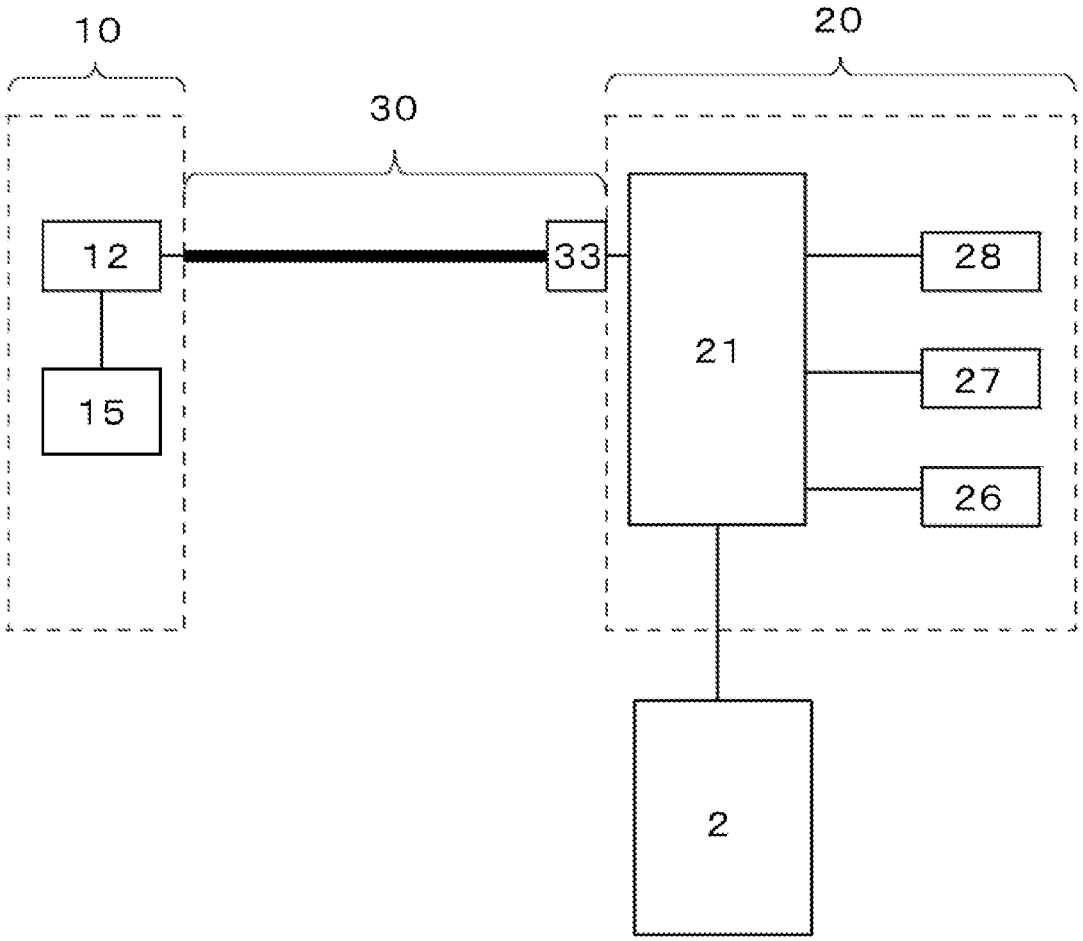

[Fig.4]
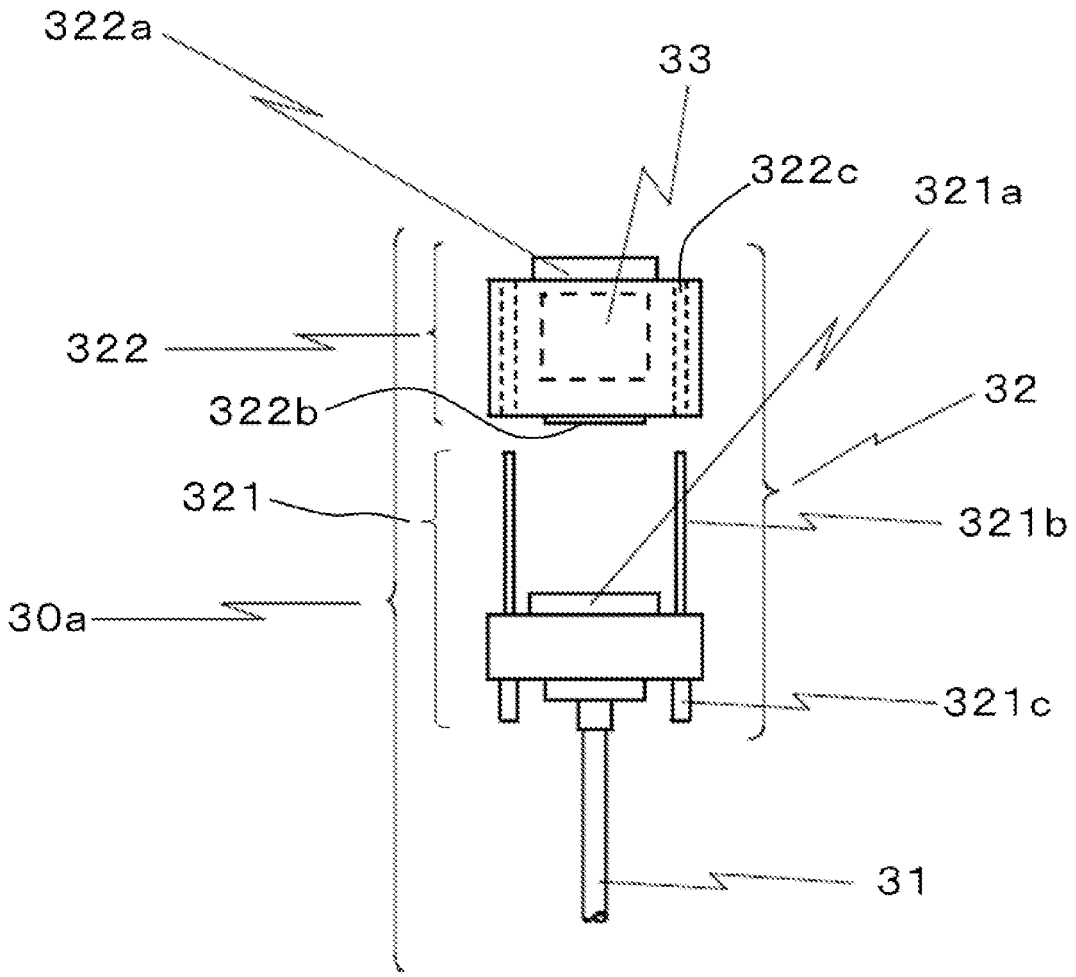

[Fig.5]
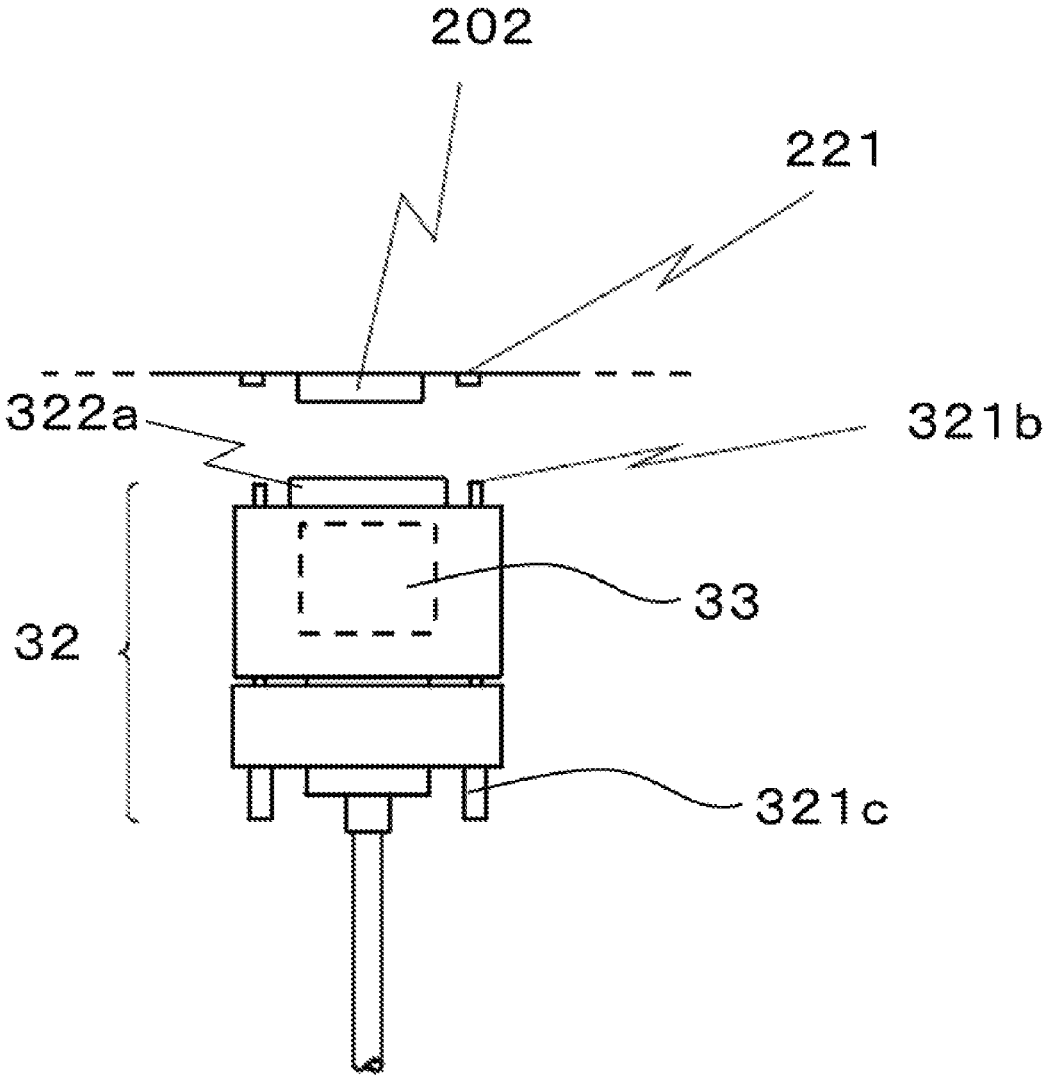

[Fig.6]
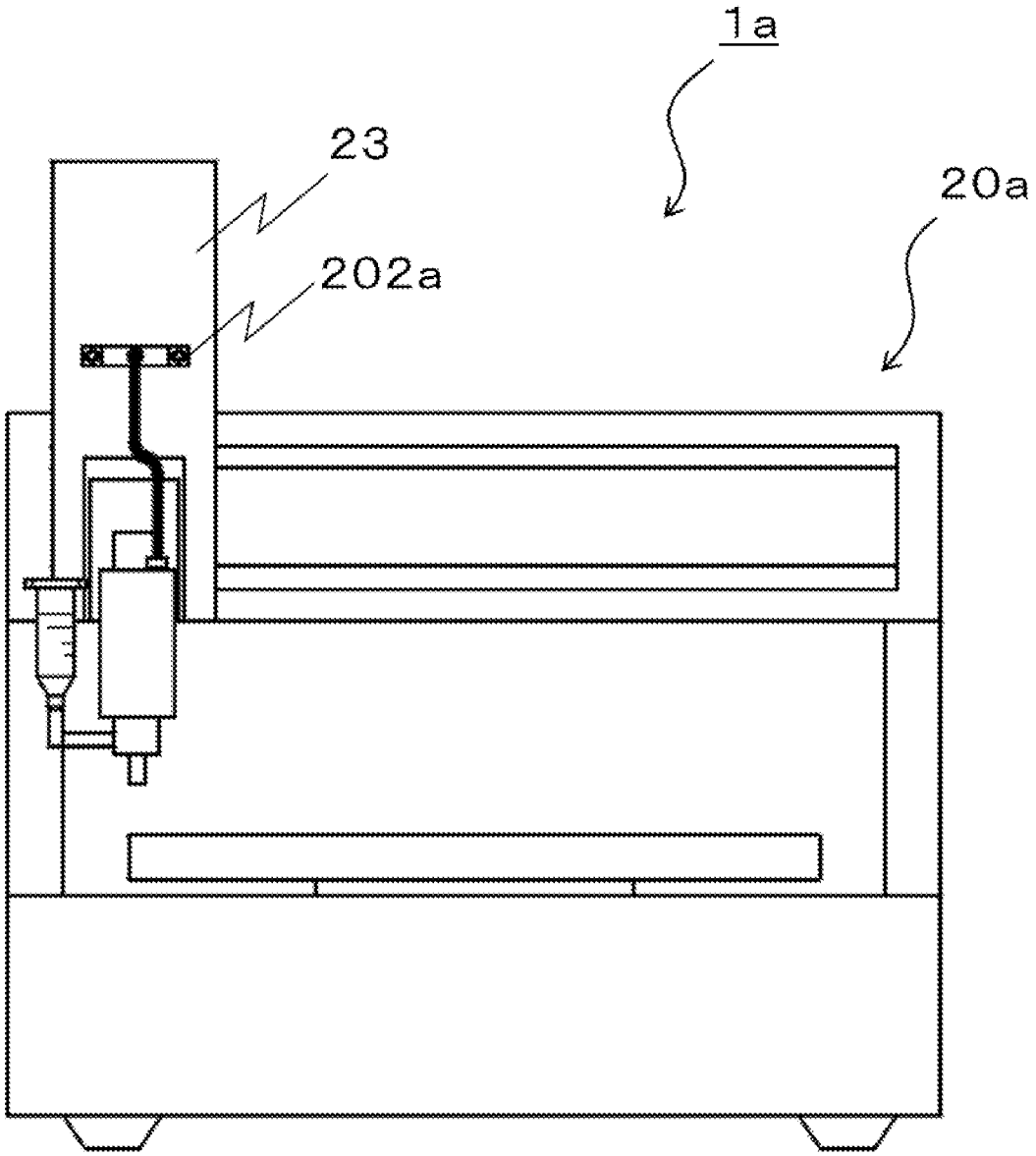

[Fig.7]
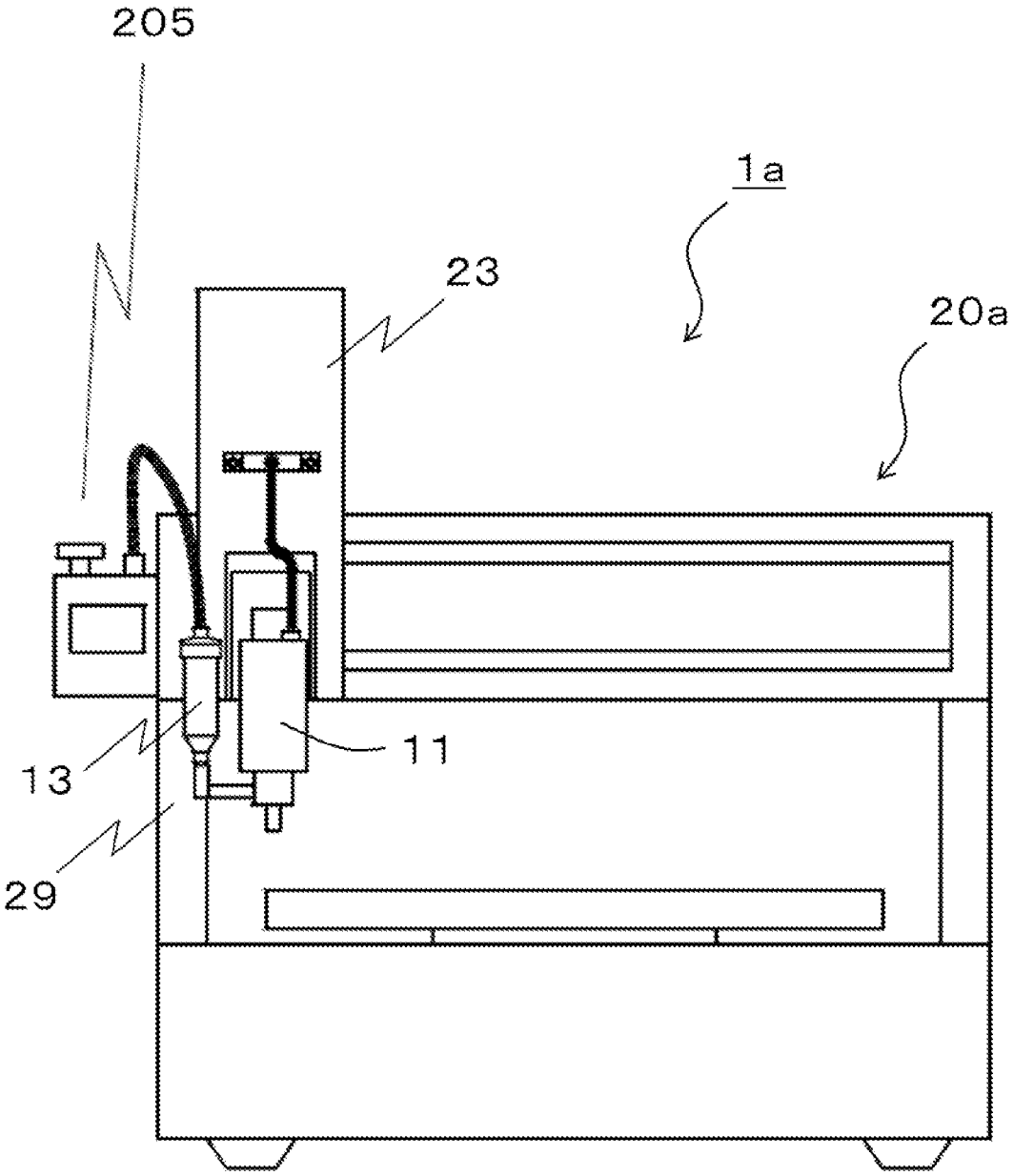

[Fig.8]
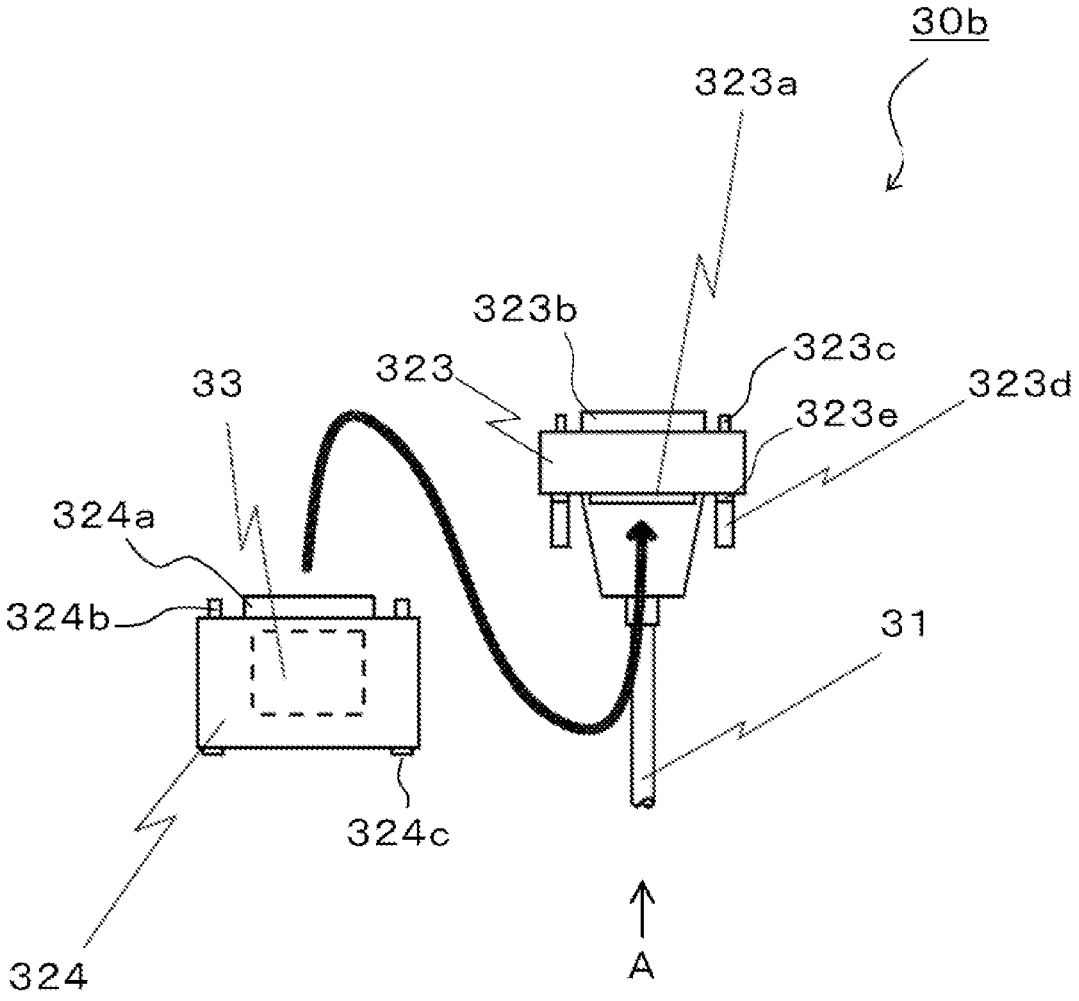

[Fig.9]
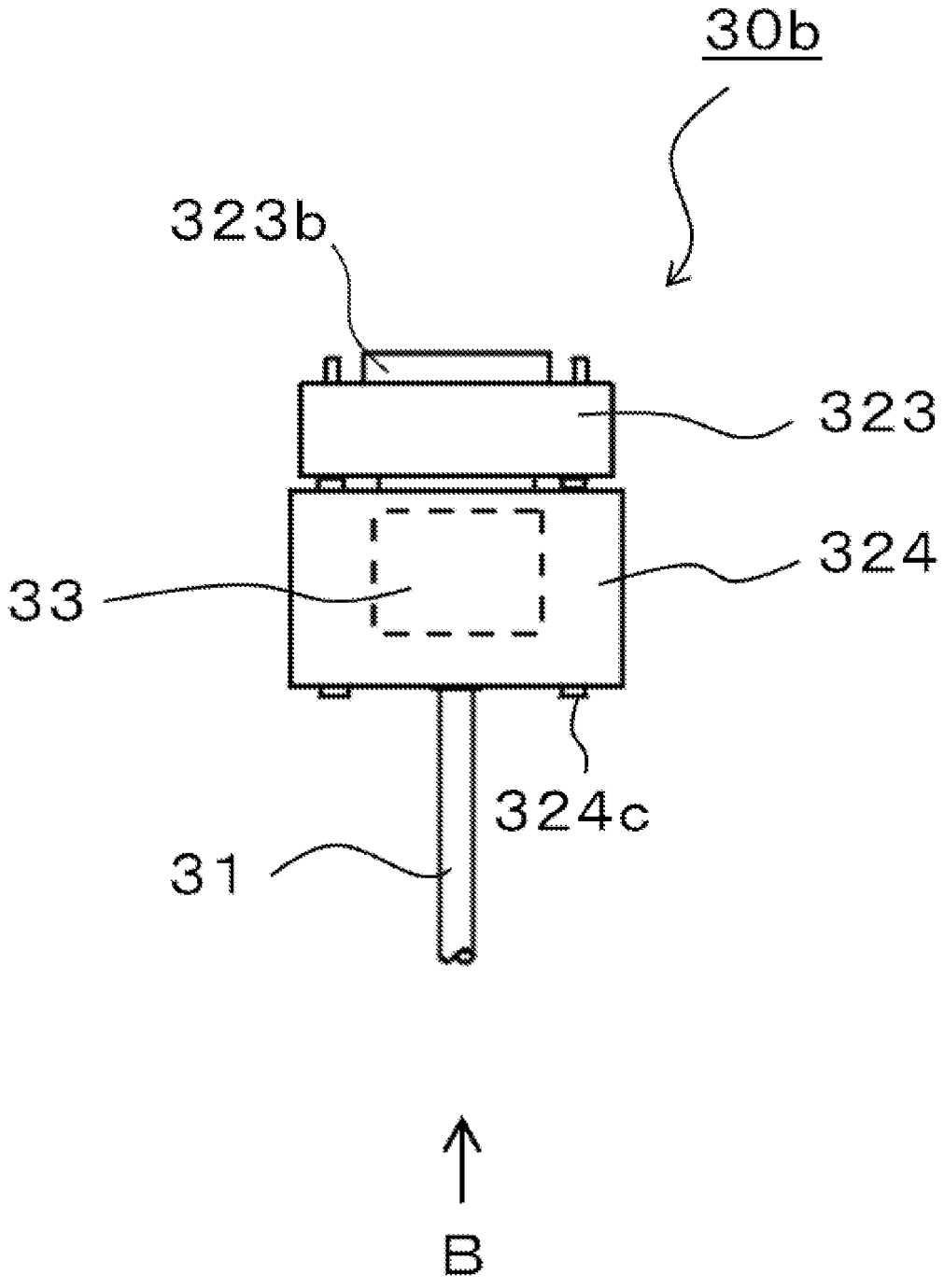

[Fig.11]
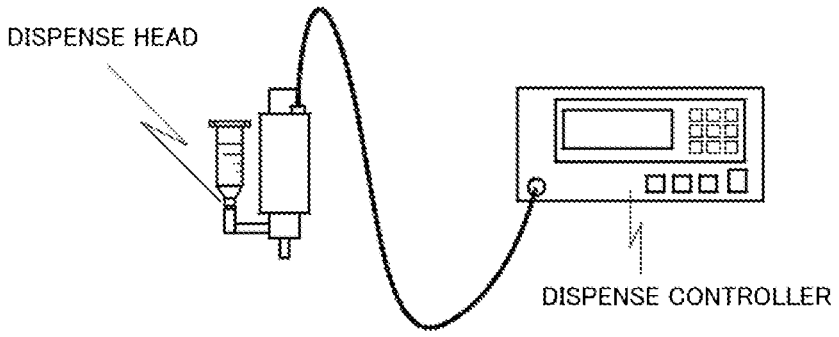
[Fig.12]
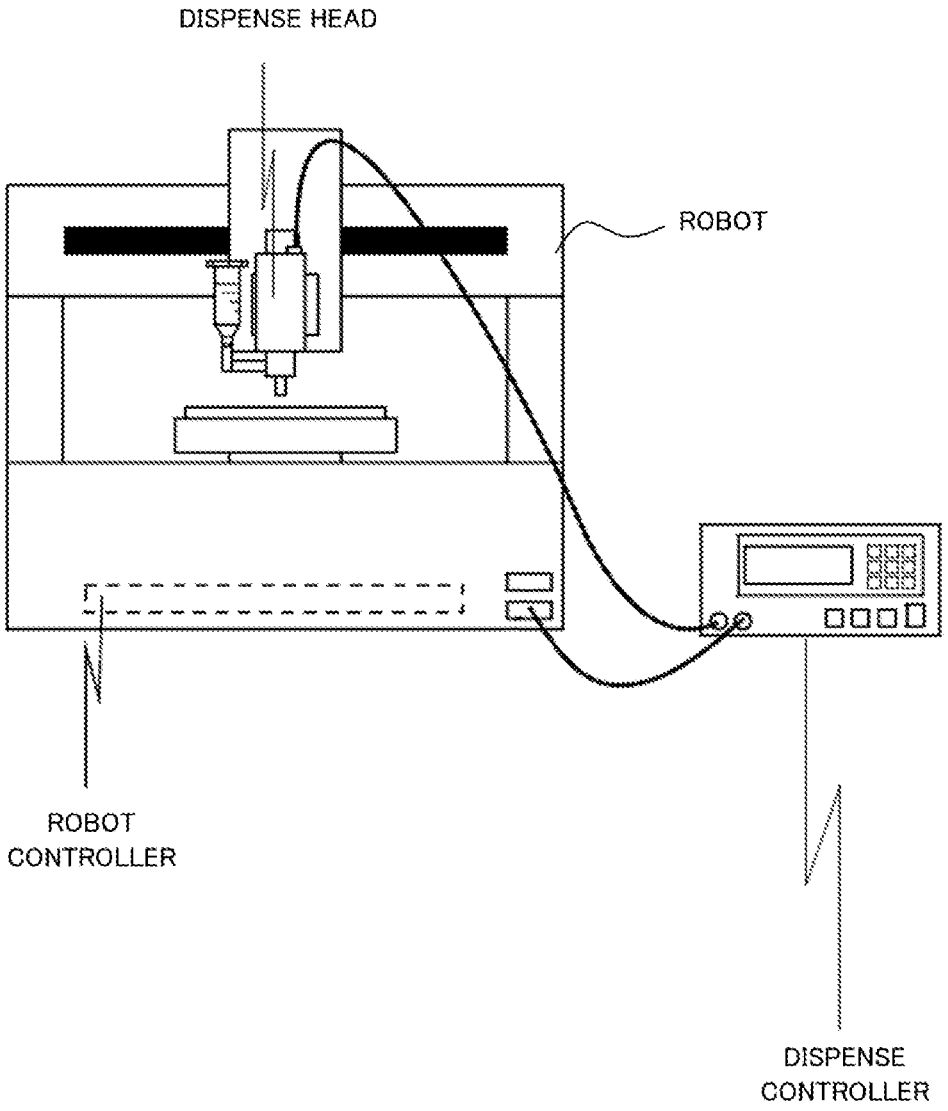

CABLE UNIT, AND LIQUID MATERIAL SUPPLY DEVICE AND APPLICATION DEVICE IN WHICH SAID CABLE UNIT IS USED

TECHNICAL FIELD

The present invention relates to a cable unit that connects a discharge head configured to supply a liquid material to a workpiece with a robot on which the discharge head is mounded, and a liquid material supply device and an application device including the cable unit.

BACKGROUND ART

In order to supply (including applying, filling with, coating with, drawing with, injecting, dripping, and spraying, the same hereinafter) a liquid material to a desired position on a workpiece (work target, the same hereinafter), an application device has been known which is a combination of a discharge head configured to supply a desired amount of liquid material, and a robot mounting the discharge head and configured to cause the discharge head to supply the liquid material to a desired position on a workpiece.

The discharge head is constituted by a dispenser, for example. Methods of discharging liquid materials by a dispenser include air-type, screw-type, tubing-type, plunger-type, and jet-type methods and the like. In general, a discharge method is often selected depending on the type of a liquid material to be discharged. In addition to a discharge method of a liquid material, a dispenser to be used is also sometimes selected depending on work takt time, discharge repetition accuracy, or the like. Meanwhile, a suitable robot (including a robot category such as a scalar robot or an XYZ robot, a size, and a movable range, for example) is selected depending on the size of a workpiece, details of work (application, filling, drawing, or the like), locating accuracy, or the like.

As shown in FIG. 11, a dispenser includes a dispense head that discharges a liquid material and a dispense controller that controls an operation of the dispense head.

When supplying a liquid material to a workpiece, as shown in FIG. 12, it is necessary to mount the dispense head on a robot head of a robot and to electrically connect the dispense controller that controls a dispenser's operation to discharge the liquid material with a robot controller that controls movements of the dispense head. The robot controller moves the dispense head to a predetermined liquid material supply position and, when the dispense head movement is complete, transmits a signal of supply start command to the dispense controller. When the dispense controller receives this signal, the dispense controller causes the dispense head to supply the liquid material based on a program set in the dispense controller.

Such devices for supplying a liquid material with a combination of a dispenser and a robot are known in Patent Documents 1 to 3, for example. That is, Patent Document 1 illustrates a configuration where a discharge controller is physically separated from a driving controller (see FIG. 17 of Patent Document 1). Patent Document 2 illustrates a work robot and a separate dispense controller (see FIG. 1 of Patent Document 2). Further, patent Document 3 illustrates a configuration where a robot controller (first control unit) and a dispense controller (second control unit) are separate control units and electrically connected with each other (see FIGS. 1 and 2 of Patent Document 3).

PRIOR ART LIST

Patent Document

Patent Document 1: Japanese Patent Laid-Open Publication No. 2013-184116

Patent Document 2: International Publication No. 2007/083585

Patent Document 3: International Publication No. 2015/083722

SUMMARY OF THE INVENTION

Problems to be Solved by the Invention

In order to secure a large work space, there is a need for saving space for a device.

An object of the present invention is to provide a cable unit that can achieve space saving for a device, and a liquid material supply device and an application device including the cable unit.

Means for Solving the Problems

The inventor has examined ways in which a discharge head and a dispense controller are integrally constituted for eliminating the box-shaped dispense controller. However, there would be problems that the dispense controller might fail due to leakage of a liquid material filling the discharge head into the dispense controller, that the heavier discharge head requires larger XYZ-driving devices, and that an existing discharge head has to be replaced. After exercising ingenuity earnestly, the inventor has come to findings of arranging a dispense controller at a connector portion of a cable, and devised the present invention. That is, the present invention is configured with the following technical means.

A cable unit according to the present invention is a cable unit that detachably and electrically connects a discharge head configured to discharge a liquid material with a relative-moving robot configured to carry out relative movement between the discharge head and a workpiece and has a dispense controller configured to control a discharge operation of the discharge head.

In the above-mentioned cable unit, the cable unit may have a cable portion and a connector portion, and the dispense controller may be arranged at the connector portion.

In the above-mentioned cable unit, the cable portion may have a communication cable for communicating with the dispense controller, and a power cable for supplying power to the discharge head.

In the above-mentioned cable unit, the connector portion may be constituted by a robot-side connector portion and a discharge-head-side connector portion, and the dispense controller may be arranged at the robot-side connector portion.

In the above-mentioned cable unit, the connector portion may have a first connector portion linked to the cable portion and a second connector portion at which the dispense controller is arranged, and the first connector portion and the second connector portion may be able to be attached to and detached from each other.

In the above-mentioned cable unit, the first connector portion may have a controller-connecting terminal to connect with the second connector portion, and the second connector portion may have a robot-connecting terminal to connect with the relative-moving robot and a connector-portion-connecting terminal to connect with the first connector portion.

In the above-mentioned cable unit, the first connector portion may have a controller-connecting terminal to connect with the second connector portion, and a robot-connecting terminal to connect with the relative-moving robot, and the second connector portion may have a connector-portion-connecting terminal to connect with the first connector portion. Further, the controller-connecting terminal may be arranged on a surface of a side at which the cable portion of the first connector portion is connected, and the robot-connecting terminal may be arranged on a surface of a side opposite to the controller-connecting terminal of the first connector portion.

In the above-mentioned cable unit, the cable unit may have no input device.

In the above-mentioned cable unit, the cable unit may have no display device.

In the above-mentioned cable unit, the cable unit may have no power source device.

A liquid material supply device according to the present invention includes the above-mentioned cable unit, and a discharge head configured to supply a liquid material.

An application device according to the present invention includes the above-mentioned liquid material supply device, and a relative-moving robot configured to carry out relative movement between the discharge head and a workpiece.

In the above-mentioned application device, the relative-moving robot may include a robot head on which the discharge head is mounted, a robot head driving device configured to move the robot head relative to the workpiece, and a robot controller configured to control an operation of the robot head, the discharge head may include a discharging member of which fore end is disposed in a liquid chamber, and a discharge driving device configured to drive the discharging member, and the dispense controller may be configured to control an operation of the discharge driving device.

In the above-mentioned application device, the relative-moving robot may include an input interface configured to communicate with an external computer, and the robot controller may have a cooperation function that enables communication between the external computer and the dispense controller.

In the above-mentioned application device, the application device may be of desktop type.

Advantageous Effect of the Invention

According to the present invention, a dispense controller is arranged at a cable unit, thereby eliminating the need to separately and individually install a dispense controller and thus allowing the space saving for a device.

BRIEF DESCRIPTION OF THE DRAWINGS

FIG. 1 is a schematic view illustrating a dispense head and a cable unit according to a first embodiment.

FIG. 2 is a schematic view illustrating an application device according to the first embodiment.

FIG. 3 is a block configuration diagram of the application device according to the first embodiment.

FIG. 4 is a (first) schematic view of a cable unit according to a second embodiment.

FIG. 5 is a (second) schematic view of the cable unit according to the second embodiment.

FIG. 6 is a schematic view illustrating an application device according to a third embodiment.

FIG. 7 is a schematic view illustrating a variation of the application device according to the third embodiment.

FIG. 8 is a (first) schematic view of a cable unit according to a fourth embodiment.

FIG. 9 is a (second) schematic view of the cable unit according to the fourth embodiment.

FIG. 11 is a schematic view illustrating a conventional dispenser.

FIG. 12 is a schematic view illustrating a conventional application device.

MODE FOR CARRYING OUT THE INVENTION

Figure 10A:
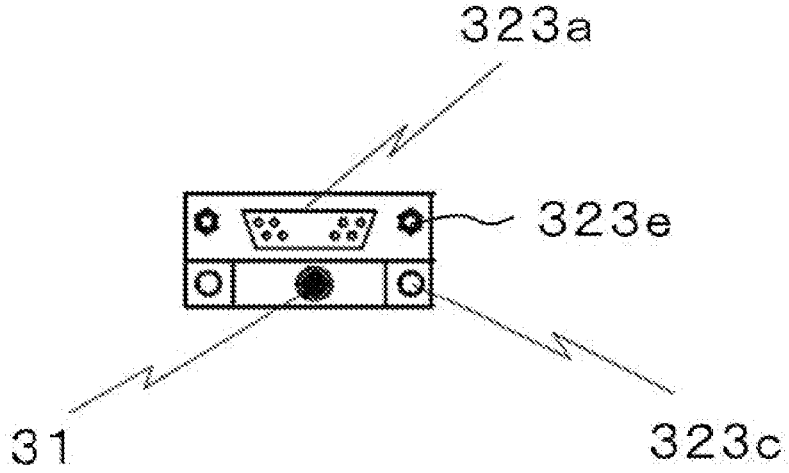
FIG. 10(A) is a view of the cable unit as viewed from the A-direction in FIG. 8.

Examples of mode for carrying out the present invention will be described below with reference to the drawings. Hereinafter, embodiment examples where a discharge head is a screw-type dispense head that discharges a liquid material by rotation of a screw will be described.

First Embodiment

FIG. 1 is a schematic view illustrating a dispenser and a cable unit according to a first embodiment. FIG. 2 is a schematic view illustrating an application device according to the first embodiment. As shown in FIG. 2, the application device 1 according to the first embodiment includes a discharge head 10 configured to supply a liquid material, a relative-moving robot 20 on which the discharge head 10 is mounted, and a cable unit 30 that electrically connects the discharge head 10 with the relative-moving robot 20.

As shown in FIG. 1, the discharge head 10 has a main body 11, a cable-connecting terminal 12, a syringe 13, and a nozzle 14. The discharge head 10 according to the present embodiment is of screw type capable of discharging a liquid material by rotation of a screw. The screw (not shown) disposed in a liquid chamber is detachably coupled to a discharge driving device 15 (not shown) in the main body 11. The discharge head 10 thus discharges a liquid material, flown from the syringe 13 into the liquid chamber, through a discharge port of the nozzle 14 by rotation of the screw. In the present embodiment, the discharge driving device 15 is configured with a rotating actuator (e.g., a mechanism using a motor). However, this configuration is not a limitation, and when the discharge method is of jet type, for example, the discharge driving device 15 is configured with a reciprocating actuator (e.g., a configuration where a piston behind a plunger is driven by air or a spring, or a configuration where a plunger is reciprocated using an electromagnet).

The discharge head 10 can receive a control signal from a dispense controller 33 by connecting a discharge-head-side connector portion 35 of the cable unit 30 with the cable-connecting terminal 12 arranged on the main body 11.

The relative-moving robot 20, on which the discharge head 10 is mounted, moves the discharge head 10 along X-, Y-, and Z-directions to a desired position on a workpiece. The relative-moving robot 20 according to the present embodiment is a desktop XYZ-orthogonal robot and, as shown in FIG. 2, has on a table 201 a work table 24 that supports a workpiece 25 as an application target and an X-driving device 26, a Y-driving device 27, and a Z-driving device 28 configured to move the above-mentioned robot head 23 relative to the workpiece 25. A robot controller 21 that controls an operation of each of the above-mentioned driving devices (26, 27, 28), and a power source device 204 are arranged inside the table 201.

The robot controller 21 includes a computing device, a storage device, and an I/O port. This storage device stores a relative movement program for leading the relative-moving robot 20 into relative movement in accordance with an application pattern and a cooperation program. An application program is described by a designated-position movement command to move the XYZ-driving devices (26 to 28) to designated coordinates along a linear or curved path, and a relative movement command to relatively convey the discharge head 10 against the work table 24 (or the workpiece 25) in accordance with the application pattern at a predetermined relative movement speed. Additionally, the application program is described by a discharge start command to cause the discharge head 10 to start discharging a liquid material, a discharge amount control command to cause the discharge head 10 to discharge a discharge amount of liquid material per unit time, and a discharge stop command to cause the discharge head 10 to stop discharging the liquid material. The discharge amount per unit time for the liquid material is controlled by the number of rotations of the screw per unit time. The number of rotations of the screw per unit time is controlled by the number of rotations of the discharge driving device 15 that rotates the screw.

The cooperation program realizes a cooperation function that enables bidirectional communication between an input device 2 and the dispense controller 33. The cooperation program causes transmission of a program and a parameter, input from the input device 2, to the dispense controller 33, and transmission of an output signal from the dispense controller 33 to the input device 2.

As shown in FIG. 2, the relative-moving robot 20 includes two connecting terminals on the front surface of the table 201 that electrically connect with the robot controller 21. Specifically, the relative-moving robot 20 has a head-connecting terminal 202 for electrically connecting with the cable unit 30, and an input-device-connecting terminal 203 as an input interface for connecting with the input device 2. The input device 2 and the input-device-connecting terminal 203 are electrically connected with each other via a communication cable 3. Note that the head-connecting terminal 202 and the input-device-connecting terminal 203 may be arranged on the side surface or the back surface of the table 201.

As shown in FIG. 1, the cable unit 30 according to the present embodiment has a cable portion 31, a robot-side connector portion 32, and a discharge-head-side connector portion 35. The dispenser controller 33 is housed in the robot-side connector portion 32. This can reduce the weight of the discharge head 10, and reduce load on the X-driving device 26 and the Z-driving device 28 when they start and stop moving the discharge head 10. The cable portion 31 has a communication cable for enabling bidirectional communication with the dispense controller 33, and a power cable for supplying power to the discharge head 10. The cable portion 31 is not necessarily constituted as a physically single cable, and may be constituted by multiple cables connecting to a body of the robot-side connector portion 32.

The robot-side connector portion 32 has a robot-connecting terminal 34*a*, a pair of pins 34*b* projecting from the front side of the robot-side connector portion 32, and a pair of knobs 34*c* projecting from the back side of the robot-side connector portion 32.

The relative-moving robot 20 has a pair of fasteners 221 with holes of which inner surfaces are threaded near the head-connecting terminal 202 (see FIG. 5 described later for details). By engaging the head-connecting terminal 202 with the robot-connecting terminal 34*a* and turning the pair of knobs 34*c*, the fore ends of the pair of pins 34*b* can be screwed into the threaded holes of the pair of fasteners 221. This enables detachable coupling between the relative-moving robot 20 and the robot-side connector portion 32 of the cable unit 30. Conversely, by turning the pair of knobs 34*c* to unscrew the fore ends of the pair of pins 34*b*, the robot-side connector portion 32 can be detached from the head-connecting terminal 202 of the relative-moving robot 20. Screw heads may be formed on the knobs 34*c* to enable attachment and detachment using a tool such as a driver.

The dispense controller 33 is preferably arranged at the connector portion (32, 35), and in particular, preferably housed in the robot-side connector portion 32 that connects with the relative-moving robot 20. The dispense controller 33 can be arranged at the discharge-head-side connector portion 35. However, it is possible to reduce the weight of the discharge head 10 by holding the dispense controller 33 in the robot-side connector portion 32 at the end opposite to the discharge-head-side connector portion 35, which is more preferable. This can reduce driving load on the X-driving device 26 and the Z-driving device 28.

In the present embodiment, a personal computer as the input device 2 can be connected with the input-device-connecting terminal 203. An operator can use the input device 2 to input a program and a parameter into the robot controller 21 and the dispense controller 33. Conventionally, input keys arranged at a box-shaped dispense controller have been used for performing an operation such as input to the dispense controller 33. In contrast, the size of the dispense controller 33 can be reduced by sharing the input device with the robot controller without any input device at the cable unit 30 such that the input device of the robot controller 21 is used for inputting to the dispense controller 33. Additionally, the size of the dispense controller 33 can be further reduced in terms of a display device by realizing a display for the dispense controller 33 with a display device of the robot controller 21 such as the above-mentioned personal computer without arranging another display device at the cable unit 30.

It should be noted that the input device 2 is not limited to a personal computer, and may be a handy device such as a teach pendant, for example.

FIG. 3 is a block configuration diagram of the application device 1 according to the first embodiment.

The cable unit 30 electrically connects the discharge head 10 with the relative-moving robot 20, and supplies power to the discharge head 10. The power is supplied to the discharge head 10 by utilizing the power source device 204 included in the relative-moving robot 20 via the robot-connecting terminal 34*a*.

The dispense controller 33 buried in the robot-side connector portion 32 includes a computing device, a storage device, and an I/O port. In this storage device, a discharge control program is stored for controlling the discharge amount. The cable unit 30 including the dispense controller 33 has no dedicated power source device and no dedicated input key, and thus can be configured compactly. The power is also supplied to the dispense controller 33 by utilizing the power source device included in the relative-moving robot 20 via the robot-connecting terminal 34*a*. The size of the robot-side connector portion 32 is not particularly limited, but the width of the robot-side connector portion 32 is 9 cm or less and the thickness thereof is 3 cm or less, for example. The dispense controller 33 can be configured by disposing respective elements on a wiring substrate or can be configured with a one-chip microcomputer.

A discharge control amount D is described in the discharge control program. The discharge control amount D controls the number of rotations per unit time of the discharge driving device (rotating actuator) 15 that rotates the screw. The computing device of the dispense controller 33 executes the discharge control program upon reception of the discharge start command from the robot controller 21, and terminates the discharge control program upon reception of the discharge stop command. The dispense controller 33 transmits the discharge control amount D described in the discharge control program to the rotating actuator 15 and leads the rotating actuator 15 into rotation according to the discharge control amount D, thereby allowing the discharge head 10 to discharge the operator's desired discharge amount of liquid material per unit time.

As described above, the cable unit 30 according to the first embodiment is a cable unit that detachably and electrically connects the discharge head 10 configured to discharge a liquid material with the relative-moving robot 20 and has the dispense controller 33 configured to control a discharge operation of the discharge head 10. This can save space for the entire application apparatus 1 compared to the case where the dispense controller 33 is separately and individually installed.

Further, the discharge head 10 can be made operable without a box-shaped dispense controller only by a simple work of changing connection destinations of the cable-connecting terminal 12 and the head-connecting terminal 202 instead of altering the discharge head 10.

Second Embodiment

A cable unit 30*a* according to a second embodiment of the present invention is configured in such a way that a robot-side connector portion 32 includes a first connector portion 321 and a second connector portion 322 that are detachably coupled to each other, which is different from the cable unit 30 according to the first embodiment. Hereinafter, differences from the first embodiment will be mainly described and common descriptions will be omitted.

FIGS. 4 and 5 are schematic views of the cable unit 30*a* according to the second embodiment. FIG. 4 shows a state where the second connector portion 322 is not connected with the first connector portion 321, and FIG. 5 shows a state where the second connector portion 322 is connected with the first connector portion 321. As shown in FIGS. 4 and 5, the cable unit 30*a* has a cable portion 31, a robot-side connector portion 32, and a discharge-head-side connector portion 35. The robot-side connector portion 32 has the first connector portion 321 and the second connector portion 322. The cable portion 31 and the first connector portion 321 are integrally linked to each other, while the first connector portion 321 and the second connector portion 322 can be attached to and detached from each other by a connector coupling mechanism.

Specifically, as shown in FIG. 4, the second connector portion 322 has a robot-connecting terminal 322*a* to connect with the relative-moving robot 20, and a connector-portion-connecting terminal 322*b* to connect with the first connector portion 321. As shown in FIG. 4, the first connector portion 321 is linked to the cable portion 31 at one end, and has a controller-connecting terminal 321*a* to connect with the second connector portion 322 at the other end. Further, in the present embodiment, the first connector portion 321 has a pair of pins 321*b*, and the second connector portion 322 has a pair of pin holes 322*c*. From another point of view, the controller-connecting terminal 321*a*, the connector-portion-connecting terminal 322*b*, the pair of pins 321*b*, and the pair of pin holes 322*c* constitute the above-mentioned connector coupling mechanism.

When connecting the first connector portion 321 with the second connector portion 322, first, the pair of pins 321*b* of the first connector portion 321 are inserted through the pair of pin holes 322*c* of the second connector portion 322, and the connector-portion-connecting terminal 322*b* of the second connector portion 322 is engaged with the controller-connecting terminal 321*a* of the first connector portion 321. The pair of pins 321*b* of the first connector portion 321 are longer than the pair of pin holes 322*c* of the second connector portion 322, which causes the fore ends of the pair of pins 321*b* to project from the pair of pin holes 322*c* when the pair of pins 321*b* are inserted through the pair of pin holes 322*c* as shown in FIG. 5. These fore ends of the pair of pins 321*b* are threaded. As shown in FIG. 5, the relative-moving robot 20 has the pair of fasteners 221 with holes of which inner surfaces are threaded near the head-connecting terminal 202.

Thus, when connecting the relative-moving robot 20 with the cable unit 30*a*, the head-connecting terminal 202 is engaged with the robot-connecting terminal 322*a* in the state of connecting the first connector portion 321 with the second connector portion 322 as shown in FIG. 5, and the fore ends of the pair of pins 321*b* projecting from the pair of pin holes 322*c* can be screwed into the pair of fasteners 221 near the head-connecting terminal 202 of the relative-moving robot 20 by turning a pair of knobs 321*c* of the first connector portion 321. Conversely, when separating the second connector portion 322 from the first connector portion 321, first, the pair of knobs 321*c* of the first connector portion 321 are turned for detaching the robot-side connector portion 32 from the head-connecting terminal 202 of the relative-moving robot 20. Then, as shown in FIG. 4, the second connector portion 322 can be detached from the first connector portion 321 by disengaging the controller-connecting terminal 321*a* of the first connector portion 321 from the connector-portion-connecting terminal 322*b* of the second connector portion 322 and extracting the pair of pins 321*b* of the first connector portion 321 from the pair of pin holes 322*c* of the second connector portion 322.

In the present embodiment, as shown in FIG. 4 or 5, the second connector portion 322 houses a dispense controller 33. The dispense controller 33 controls a discharge operation of the discharge head 10 as in the first embodiment.

As described above, in the cable unit 30*a* according to the present embodiment, the robot-side connector portion 32 is formed of the first connector portion 321 and the second connector portion 322. The second connector portion 322 houses the dispense controller 33, and can be attached to and detached from the first connector portion. This enables change of the discharge control program by replacing the second connector portion 322 without modifying the program in the dispense controller 33. That is, by replacing a second connector portion 322 housing a dispense controller 33 storing a program A with another second connector portion 322 housing a dispense controller 33 storing a program B, a discharge operation of the discharge head 10 based on the program A can be easily changed into a discharge operation based on the program B. In the case of cable breakage in the cable unit 30, the second connector portion 322 can be detached from the broken cable portion 31 and the first connector portion 321, and it is possible to replace only the cable portion 31 and the first connector portion 321, which are relatively inexpensive. In the case of failure of the dispense controller 33 due to effect of static electricity or the like, it is also possible to replace only the second connector portion 322.

Third Embodiment

An application device 1*a* according to a third embodiment of the present invention is configured in such a way that a head-connecting terminal 202*a* to connect with the cable unit 30 is arranged at a robot head 23, which is different from the application device 1 according to the first embodiment. Hereinafter, differences from the first embodiment will be mainly described and common descriptions will be omitted.

FIG. 6 is a front view illustrating the application device 1*a* according to the third embodiment. In the application device 1*a* according to the third embodiment, the head-connecting terminal 202*a* that connects with the cable unit 30 is arranged at the front side of the robot head 23 of a relative-moving robot 20*a*. This can shorten the cable portion 31 of the cable unit 30, and eliminate the bustle of the cable portion 31 that arises during movement of the robot head 23. An input-device-connecting terminal 203 is not shown in FIG. 6. Note that the connection with the input device 2 is not limited to wired communication, and a wireless module allowing the relative-moving robot 20*a* to wirelessly communicate with the input device 2 may constitute an input interface.

Additionally, as shown in FIG. 7, the application device 1*a* can have a configuration where a pressure-adjusting unit 205 including a regulator (pressure-reducing valve) is connected to the side surface of a post 29 of the relative-moving robot 20*a*. The pressure-adjusting unit 205 adjusts the pressure of air supplied from the outside to a desired pressure with the regulator, and supplies the adjusted air from the upper end of the syringe 13 into the syringe 13. In this manner, even when a liquid material stored in a reservoir is a material with a low fluidity such as a highly viscous material, the liquid can be smoothly delivered to the main body 11 of the discharge head 10 by applying backup pressure to the syringe 13.

Thus, in the application device 1*a* according to the third embodiment, the head-connecting terminal 202*a* to connect with the cable unit 30 is arranged at the robot-head 23 of the relative-moving robot 20*a*, thereby shortening the cable portion 31 of the cable unit 30 and resulting in reduction of a failure risk and cost.

Fourth Embodiment

A cable unit 30*b* according to a fourth embodiment of the present invention is configured in such a way that a second connector portion 324 is connected to the back side of the first connector portion 323, which is different from the cable unit 30*a* according to the second embodiment. Hereinafter, differences from the second embodiment will be mainly described and common descriptions will be omitted.

Figure 10B:
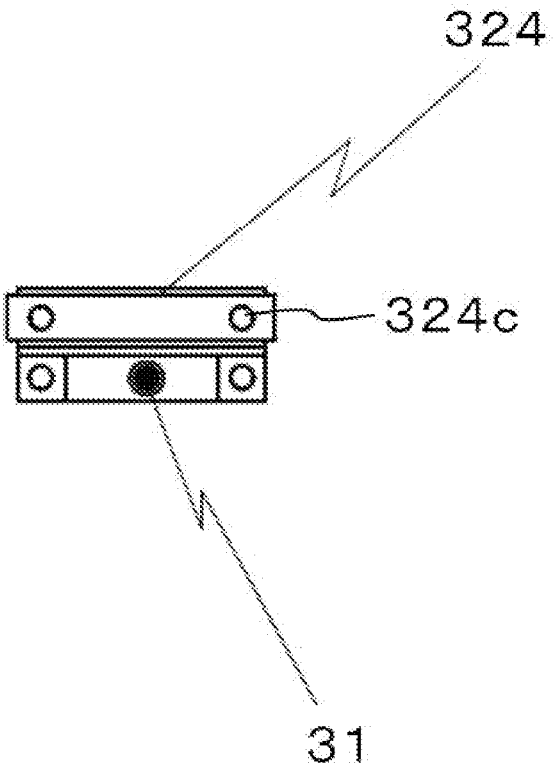
FIG. 10(B) is a view of the cable unit as viewed from the B-direction in FIG. 9.

FIGS. 8 and 9 are views illustrating the cable unit 30*b* according to the fourth embodiment. FIG. 8 shows a state where the second connector portion 324 is not connected with the first connector portion 323, and FIG. 9 shows a state where the second connector portion 324 is connected with the first connector portion 323. FIG. 10(A) shows a view of the cable unit 30*b* as viewed from the A-direction in FIG. 8, and FIG. 10(B) shows a view of the cable unit 30*b* as viewed from the B-direction in FIG. 9.

As shown in FIGS. 8 and 9, the second connector portion 324 according to the fourth embodiment has a connector-portion-connecting terminal 324*a* to connect with the first connector portion 323. As in the second embodiment, the second connector portion 324 houses a dispense controller 33. As shown in FIG. 8, the first connector portion 323 according to the fourth embodiment is linked to the cable portion 31, and has a controller-connecting terminal 323*a* to connect with the second connector portion 324 and a robot-connecting terminal 323*b* to connect with the robot at one end.

When connecting the relative-moving robot 20 with the cable unit 30*b*, first, the controller-connecting terminal 323*a* of the first connector portion 323 is engaged with the connector-portion-connecting terminal 324*a* of the second connector portion 324. The second connector portion 324 has a pair of pins 324*b* and a pair of knobs 324*c*. Further, as shown in FIG. 10(A), the first connector portion 323 has a pair of fasteners 323*e*. Thus, the pair of pins 324*b* of the second connector portion 324 are inserted into the threaded holes of the pair of fasteners 323*e* of the first connector portion 323, and then the pair of knobs 324*c* of the second connector portion 342 are turned. In this way, the pair of pins 324*b* of the second connector portion 324 can be screwed into the pair of fasteners 323*e* of the first connector portion 323, and the second connector portion 324 and the first connector portion 323 can be detachably coupled to each other. From another point of view, the controller-connecting terminal 323*a*, the connector-portion-connecting terminal 324*a*, the pair of pins 324*b*, the pair of knobs 324*c*, and the fasteners 323*e* constitute a connector coupling mechanism.

Further, the first connector portion 323 has a pair of pins 323*c* and a pair of knobs 323*d*. Then, as shown in FIG. 9, the robot-connecting terminal 323*b* of the first connector portion 323 is engaged with the head-connecting terminal 202 of the relative-moving robot 20 in a state where the second connector portion 324 is fixed to the first connector portion 323. Further, inserting the pair of pins 323*c* of the first connector portion 323 into the pair of fasteners 221 of the relative-moving robot 20, and turning the pair of knobs 323*d* of the first connector portion 323 causes the pair of pins 323*c* of the first connector portion 323 to be screwed into the pair of fasteners 221 of the relative-moving robot 20. This enables detachable coupling between the cable unit 30*b* and the relative-moving robot 20.

Conversely, when separating the second connector portion 324 from the first connector portion 323, the second connector portion 324 can be detached from the first connector portion 323 by just turning the pair of knobs 324*c* of the second connector portion 324 without uncoupling the cable unit 30*b* from the relative-moving robot 20.

Thus, in the cable unit 30*b* according to the fourth embodiment, the second connector portion 324 housing the dispense controller 33 has the connector-portion-connecting terminal 324*a* to connect with the first connector portion 323, and the first connector portion 323 has the controller-connecting terminal 323*a* to connect with the second connector portion 324 and the robot-connecting terminal 323*b* to connect with the robot. In this manner, when replacing the second connector portion 324, the cable unit 30*b* does not need to be detached from the relative-moving robot 20 and the second connector portion 324 can be replaced by just turning the pair of knobs 324*c* of the second connector portion 324.

The preferred embodiment examples of the present invention have been described above. However, the technical scope of the present invention is not limited to the description of the above embodiments. Various alterations and modifications can be applied to the above embodiment examples, and such altered or modified modes also fall within the technical scope of the present invention Specifically, discharge methods to which the present invention is applicable are not limited to the screw-type method. The present invention is applicable to any type of discharge head that includes a discharge driving device that drives a discharging member disposed in a liquid chamber. For example, the present invention is applicable to: a plunger type that causes a plunger (a discharging member) to move by a desired amount to carry out discharge, the plunger sliding in close contact with the inner surface of a reservoir having a nozzle at the fore end; a valve type that controls discharge of a liquid material to which a desired pressure is applied by opening and closing a needle valve (a discharging member); a valve element seating style jet type (e.g., a jet type that causes a valve element (a discharging member) to collide against a valve seat to discharge a liquid material); and a valve element non-seating style jet type (e.g., a plunger jet type that causes a plunger (a discharging member) to move forward and then stop suddenly for applying inertial force to a liquid material to discharge the liquid material).

In the embodiment examples, configurations have been set forth where application is carried out with a workpiece placed on a work table. However, the configurations are not limitations and there may also be a configuration where application to a workpiece is carried out using a workpiece holding device that holds the workpiece by clamping a rim of the workpiece, for example. Application to a workpiece may also be carried out while the workpiece is moving or is temporarily paused using a workpiece holding device (e.g., a belt conveyer) arranged independently of the relative-moving robot. In this case, the relative-moving robot has no workpiece holding means, and moves the discharge head relative to the workpiece held by the external workpiece holding device.

LIST OF REFERENCE SYMBOLS

1, 1*a* application device
2 input device
3 communication cable
10 dispense head (discharge head)
11 main body
12 cable-connecting terminal
13 syringe
14 nozzle
15 discharge driving device
20, 20*a* relative-moving robot
21 robot controller
23 robot head
24 work table
25 workpiece
26 X-driving device
27 Y-driving device
28 Z-driving device
29 post
201 table
202, 202*a* head-connecting terminal
203 input-device-connecting terminal
204 power source device
205 pressure-adjusting unit
221 pair of fasteners
30, 30*a*, 30*b* cable unit
31 cable portion
32 robot-side connector portion
321, 323 first connector portion
321*a*, 323*a* controller-connecting terminal
323*b* robot-connecting terminal
321*b*, 323*c* pair of pins
321*c*, 323*d* pair of knobs
323*e* pair of fasteners
322, 324 second connector portion
322*a* robot-connecting terminal
322*b*, 324*a* connector-portion-connecting terminal
322*c* pair of pin holes
324*a* connector-portion-connecting terminal
324*b* pair of pins
324*c* pair of knobs
33 dispense controller
34*a* robot-connecting terminal
34*b* pair of pins
34*c* pair of knobs
35 discharge-head-side connector portion

The invention claimed is:

1. A cable unit that detachably and electrically connects a discharge head configured to discharge a liquid material with a relative-moving robot configured to carry out relative movement between the discharge head and a workpiece, the cable unit comprising:

a cable;

a discharge-head side connector disposed at and connected to one longitudinally end of the cable, the discharge-head side connector being configured to be detachably and electrically connected directly to the discharge head configured to discharge the liquid material;

a robot-side connector disposed at and connected to an opposite longitudinally end of the cable opposite to the one longitudinally end, the robot-side connector being configured to be detachably and electrically connected directly to the relative-moving robot configured to carry out relative movement between the discharge head and the workpiece; and a dispense controller configured to control a discharge operation of the discharge head, wherein the dispense controller is disposed to the discharge-head side connector or the robot-side connector.

2. The cable unit according to claim 1, wherein the cable has a communication cable for communicating with the dispense controller, and a power cable for supplying power to the discharge head.

3. The cable unit according to claim 1, wherein the dispense controller is disposed inside the robot-side connector.

4. The cable unit according to claim 1, wherein the robot-side connector or the discharge-head side connector has a first connector portion linked to the cable and a second connector portion at which the dispense controller is arranged, and the first connector portion and the second connector portion are able to be attached to and detached from each other.

5. The cable unit according to claim 4, wherein the robot-side connector has the first connector portion, the first connector portion has a controller-connecting terminal to connect with the second connector portion, and the second connector portion has a robot-connecting terminal to connect with the relative-moving robot, and a connector-portion-connecting terminal to connect with the first connector portion.

6. The cable unit according to claim 4, wherein the robot-side connector has the first connector portion, the first connector portion has a controller-connecting terminal to connect with the second connector portion, and a robot-connecting terminal to connect with the relative-moving robot, and the second connector portion has a connector-portion-connecting terminal to connect with the first connector portion.

7. The cable unit according to claim 6, wherein the controller-connecting terminal is arranged on a surface of a side at which the cable of the first connector portion is connected, and the robot-connecting terminal is arranged on a surface of a side opposite to the controller-connecting terminal of the first connector portion.

8. The cable unit according to claim 1, wherein the cable unit has no input device.

9. The cable unit according to claim 1, wherein the cable unit has no display device.

10. The cable unit according to claim 1, wherein the cable unit has no power source device.

11. The cable unit according to claim 1, wherein the dispense controller executes a discharge control program to control the discharge operation of the discharge head upon reception of a discharge start command from a robot controller of the relative-moving robot.

12. The cable unit according to claim 1, wherein the dispense controller comprises a computing device and a storage device.

13. A liquid material supply device comprising:

the cable unit according to claim 1; and a discharge head configured to supply a liquid material.

14. An application device comprising:

the liquid material supply device according to claim 13; and a relative-moving robot configured to carry out relative movement between the discharge head and a workpiece.

15. The application device according to claim 14, wherein the relative-moving robot comprises a robot head on which the discharge head is mounted, a robot head driving device configured to move the robot head relative to the workpiece, and a robot controller configured to control an operation of the robot head, the discharge head comprises a discharging member of which fore end is disposed in a liquid chamber, and a discharge driving device configured to drive the discharging member, and the dispense controller is configured to control an operation of the discharge driving device.

16. The application device according to claim 15, wherein the relative-moving robot comprises an input interface configured to communicate with an external computer, and the robot controller has a cooperation function that enables communication between the external computer and the dispense controller.

17. The application device according to claim 14, wherein the application device is of desktop type.

* * * * *